US006998553B2

(12) United States Patent
Hisamune et al.

(10) Patent No.: US 6,998,553 B2
(45) Date of Patent: Feb. 14, 2006

(54) ROTARY MANIPULATION TYPE ELECTRONIC COMPONENT

(75) Inventors: Hiroaki Hisamune, Okayama (JP); Takumi Nishimoto, Okayama (JP); Jun Sato, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 187 days.

(21) Appl. No.: 10/341,939

(22) Filed: Jan. 14, 2003

(65) Prior Publication Data

US 2003/0160680 A1 Aug. 28, 2003

(30) Foreign Application Priority Data

Jan. 25, 2002 (JP) ..... 2002-016554

(51) Int. Cl.
*H01H 19/14* (2006.01)

(52) U.S. Cl. ..... 200/336; 200/4; 200/564; 200/570; 200/571

(58) Field of Classification Search ..... 200/4, 200/11 R–11 G, 564, 570, 571, 336
See application file for complete search history.

(56) References Cited

U.S. PATENT DOCUMENTS 4,320,267 A * 3/1982 Greve et al. ..... 200/4
4,866,219 A * 9/1989 Riding et al. ..... 200/4
5,039,830 A * 8/1991 Orillard ..... 200/61.39
5,278,364 A * 1/1994 Misawa et al. ..... 200/11 R
5,310,974 A * 5/1994 Churchill et al. ..... 200/566
5,705,778 A * 1/1998 Matsui et al. ..... 200/11 R
5,744,873 A * 4/1998 Hasegawa et al. ..... 307/10.1
6,396,006 B1 * 5/2002 Yokoji et al. ..... 200/4

FOREIGN PATENT DOCUMENTS

JP 2000-029631 A 1/2000

OTHER PUBLICATIONS

Chinese Office Action for 03102915.9, dated Jan. 16, 2004.

* cited by examiner

*Primary Examiner*—Michael A. Friedhofer
(74) *Attorney, Agent, or Firm*—RatnerPrestia

(57) ABSTRACT

A rotary manipulation type electronic component includes a space formed by a case. A base houses a rotating body holding a resilient contact as a movable element. A comb-like contact is formed as a fixed element. A first bushing in the case and a second bushing in the base rotatably support a rotating shaft that rotates together with the rotating body. An inner bottom face of a cap-shaped knob is secured onto an end of the rotating shaft so that the knob receives a barrel portion, which supports the rotating shaft as a portion of the case.

14 Claims, 9 Drawing Sheets

ROTARY MANIPULATION TYPE ELECTRONIC COMPONENT

TECHNICAL FIELD

The present invention relates to a rotary manipulation type electronic component in which an electric signal is generated by rotary manipulation of a knob thereof.

BACKGROUND OF THE INVENTION

A conventional rotary encoder is described with reference to FIGS. 11 and 12.

FIG. 11 is a sectional view of a conventional rotary encoder. The conventional encoder includes base 1 having concentric circular comb-like contact 3 as a fixed element on the inner top face thereof, and case 2 covering the top face of the base. Housed in a space formed by the case 2 and the base 1 is rotating body 5 that holds resilient contact 4 for engaging with comb-like contact 3 to generate an electric signal.

Straight rod-like rotating shaft 6 has upper portion 6A, intermediate portion 6B, and lower portion 6C. Intermediate portion 6B is rotatably supported by cylindrical bushing 7 in the upper portion of case 2. Upper portion 6A protruding upwardly from bushing 7 is covered with control knob 8. The rotating body 5 is joined by caulking to lower portion 6C protruding into the space formed by the case and the base. Connecting fitting 9 fastens base 1 and case 2.

Next, the operation of this rotary encoder is described with reference to FIG. 12 for explaining how the elements are engaged with each other. When knob 8 is rotated, rotating shaft 6 and rotating body 5 make rotary motion with the circular hole through bushing 7 as center. This brings the tip of resilient leg 4A held by rotating body 5 into resilient sliding contact with comb-like contact 3. Thereby, a pulse signal corresponding to the rotary manipulation is output from terminal 10 connected to comb-like contact 3.

In recent years, progress in performance as well as downsizing and high-density has been made mainly in portable electronic equipment. This necessitates smaller electronic components having higher performance. Especially for electronic components for use in the control part of portable electronic equipment, a small height including a control knob thereof and high precision are required.

However, for the conventional rotary encoder, in order to reduce the height including knob 8 without changing the dimension of a body portion that houses the elements of the electronic component, length L1 of bushing 7 (see FIG. 11) must be reduced. This is because the conventional rotary encoder is structured so that rotating shaft 6 is supported by bushing 7 of case 2 that constitutes the body portion housing the elements, and upper portion 6A is covered with knob 8.

On the other hand, a gap of approx. 0.03 mm must be provided between the outer diameter of intermediate portion 6B and the inner diameter of the cylindrical hole through bushing 7 that rotatably supports rotating shaft 6. Thus, reducing length L1 of bushing 7 reduces the length over which rotating shaft 6 is supported and increases the runout of rotating shaft 6. Therefore, knob 8 provided over upper portion 6A makes more back-lashes. As a result, there are problems: the operational sensation deteriorates and resilient contact 4 held by rotating body 5 that is fixed to lower portion 6C makes misregistration, although it is small.

SUMMARY OF THE INVENTION

The present invention addresses the conventional problems and aims to provide a high-precision small electronic component of the rotary manipulation type that has a small height including the knob and small runout of the rotating shaft.

In order to achieve the object, a rotary manipulation type electronic component of the present invention includes:

- an electric signal generating element including a fixed element and a movable element;
- a rotating body holding the movable element;
- a case and a base forming a space for housing the electric signal generating element and the rotating body;
- a straight rod-like rotating shaft having the rotating body engaged with an intermediate portion thereof so that the rotating body rotates together with the rotating shaft; and
- a knob having a top end of the rotating shaft connected and secured to a center of an inner bottom of a cap shape thereof and receiving a rotating shaft supporting portion of the case;
- in which an upper portion of the rotating shaft is rotatably supported by a top end of the case, and a lower portion of the rotating shaft is rotatably supported by the base.

DETAILED DESCRIPTION

Exemplary embodiments of the present invention are demonstrated hereinafter with reference to FIGS. 1 to 10.

In the description, constituents similar to those in the Background Art have the same reference marks.

Embodiment 1

Figure 1:
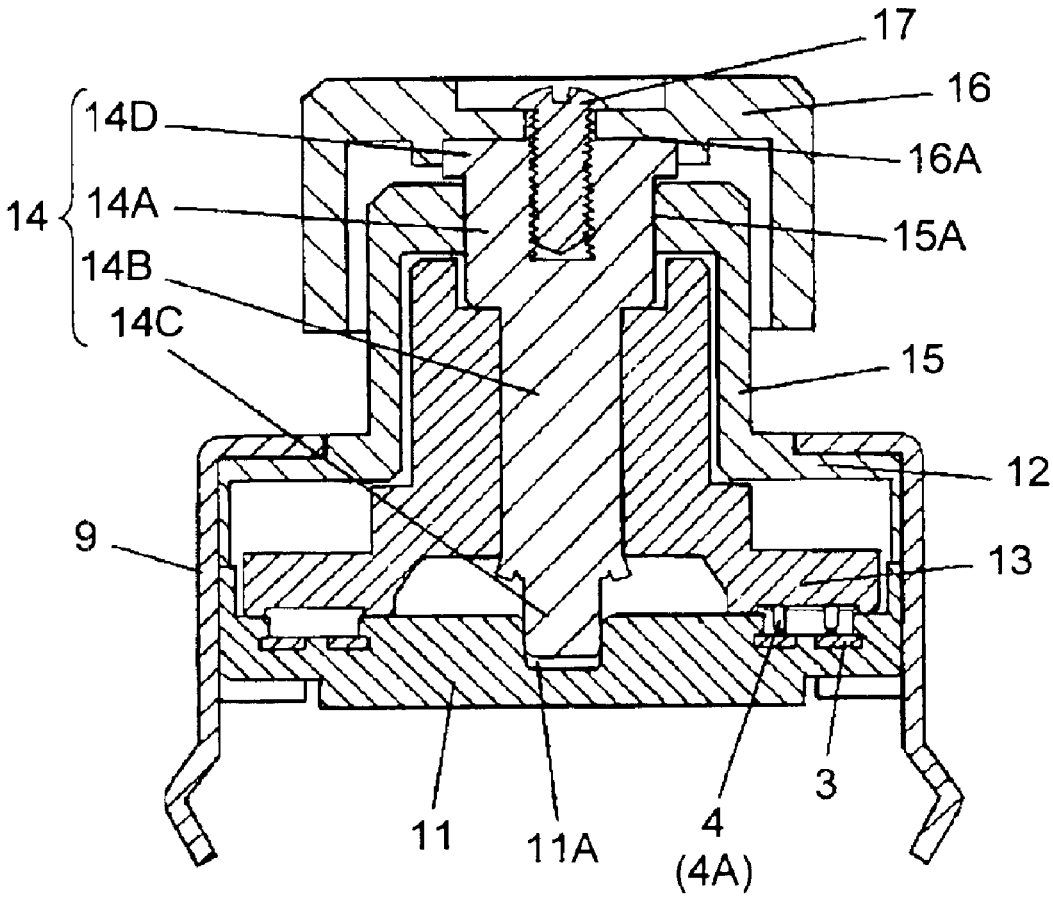
FIG. 1 is a sectional view of a rotary encoder described in a embodiment 1 of the present invention.
Figure 2:
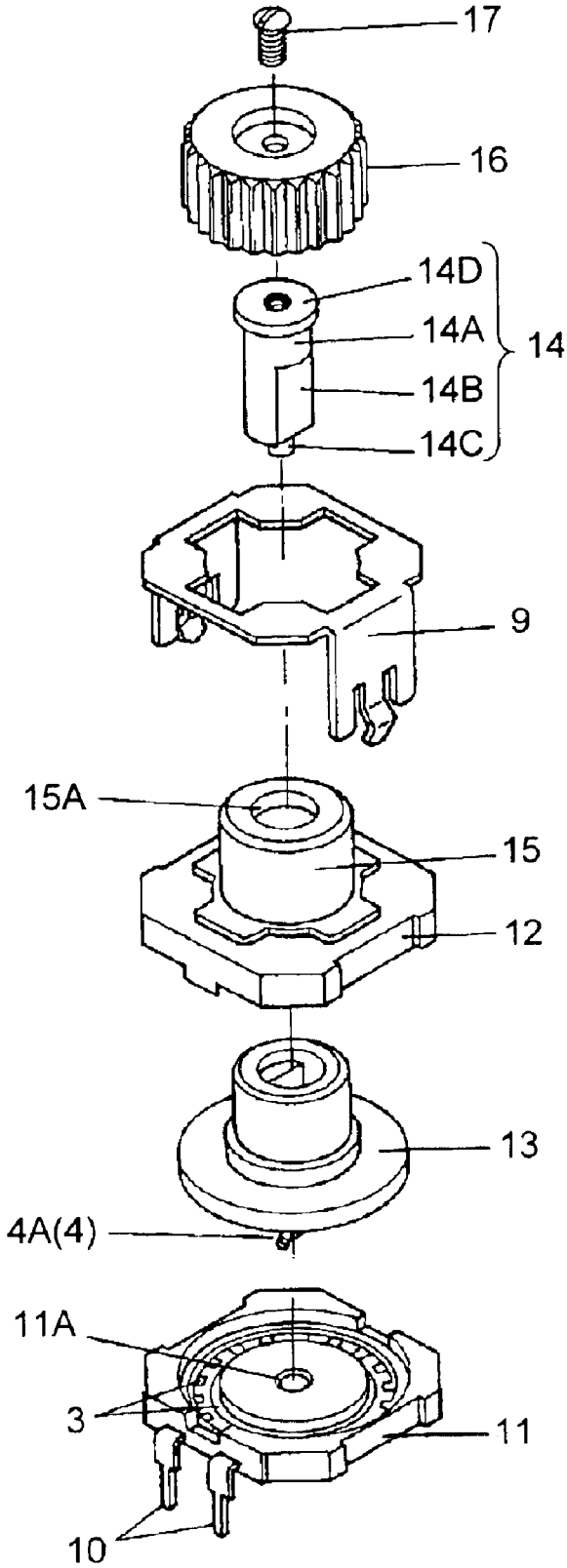
FIG. 2 is an exploded perspective view of the rotary encoder described in the embodiment 1.

FIGS. 1 and 2 are a sectional view and an exploded perspective view, respectively, of a rotary encoder described in the embodiment 1 with reference to a rotary manipulation type electronic component of the present invention.

In the drawings, base 11 has concentric circular comb-like contact 3 as a fixed element on an inner top face thereof. The top face of the base is covered with case 12. Housed in a space formed by case 11 and base 12 is rotating body 13 that holds resilient contact 4 as a movable element for engaging with comb-like contact 3 to generate an electric signal. Rotating body 13 is joined by caulking and fixed to non-circular portion 14B in the middle of straight rod-like rotating shaft 14 to rotate together therewith. As for rotating shaft 14, upper circular portion 14A and lower circular portion 14C thereof are rotatably supported by top-end small circular portion (hereinafter referred to as a "first bushing") 15A along the inner circumference of cylindrical barrel portion 15 in the upper portion of case 12, and circular recess (hereinafter referred to as a "second bushing") 11A in the top face of base 11, respectively. Top end 14D of rotating shaft 14 slightly protrudes from the top end of barrel portion 15.

Cap-shaped knob 16 having a recess in a lower portion thereof covers barrel portion 15 protruding upwardly as the upper portion of case 12 and top end 14D of rotating shaft 14, and holds rotating shaft 14. First bushing 15A along the inner circumference of barrel portion 15 is covered with knob 16. In other words, barrel portion 15 serving as a rotating shaft supporting portion of case 12 is received in knob 16. Knob 16 is secured onto top end 14D of rotating shaft 14 with machine screw 17 threaded through a central hole in inner bottom face 16A of the knob.

Securing the knob using machine screw 17 allows the thin bottom of cap-shaped knob 16 and top end 14D of rotating shaft 14 to be fixed securely. Additionally, the shape and color of knob 16 can easily be changed. Base 11 and case 12 are fastened by connecting fitting 9.

Next, a description is provided of the operation of the rotary encoder structured as above.

When knob 16 is rotated, rotating shaft 14 and rotating body 13 make rotary motion with first bushing 15A along the inner circumference of barrel portion 15 and second bushing 11A in base 11 as center. This brings the tip of resilient leg 4A held by rotating body 13 into resilient sliding contact with comb-like contact 3. Thereby, a pulse signal corresponding to the rotary manipulation outputs from terminal 10.

For the embodiment 1, the height including knob 16 is small because cap-shaped knob 16 covers first bushing 15A along the inner circumference of barrel portion 15. Additionally, the length between the supporting points of rotating shaft 14, i.e. first bushing 15A along the inner circumference of barrel portion 15 and second bushing 11A in base 11, can be set larger, without increasing the dimensions of base 11 and case 12 that form a body portion for housing comb-like contact 3 and resilient contact 4, i.e. the electric signal generating element. Therefore, even when a gap of approx. 0.03 mm, which is substantially equal to that of the conventional rotary encoder, is provided in both supporting points, a high-precision small rotary encoder that has small runout of rotating shaft 14 and less back-lash knob 16 can be realized.

Figure 3:
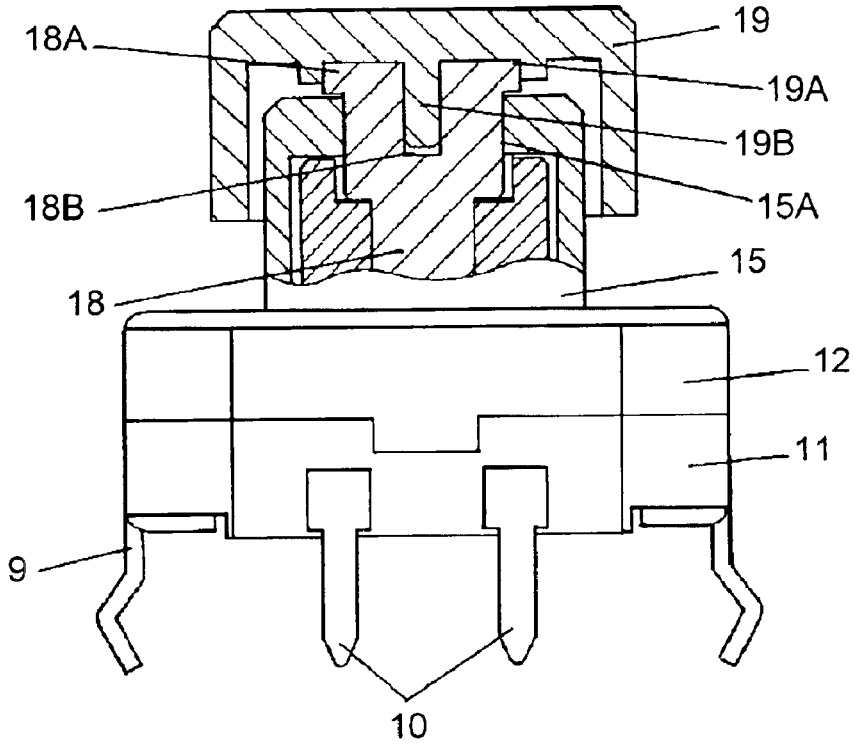
FIG. 3 is a partially sectional view of a second rotary encoder described in the embodiment 1.

Described in this embodiment is a case where cap-shaped knob 16 is secured onto top end 14D of rotating shaft 14 with machine screw 17. However, instead of using a machine screw, as shown in FIG. 3, i.e. a front view of a partial section of a rotary encoder of a second structure in accordance with this embodiment, cap-shaped knob 19 can be secured by press-fitting non-circular leg 19B into non-circular hole 18B. Non-circular leg 19B is integrally formed on inner bottom face 19A from the center thereof perpendicularly and downwardly. Non-circular hole 18B is provided at the center of top end 18A of straight rod-like rotating shaft 18 perpendicularly and downwardly.

This structure allows the thin bottom of cap-shaped knob 19 and top end 18A of rotating shaft 18 to be fastened easily at low cost without using another connecting member. Additionally, the shape and color of knob 19 can easily be changed.

Figure 4:
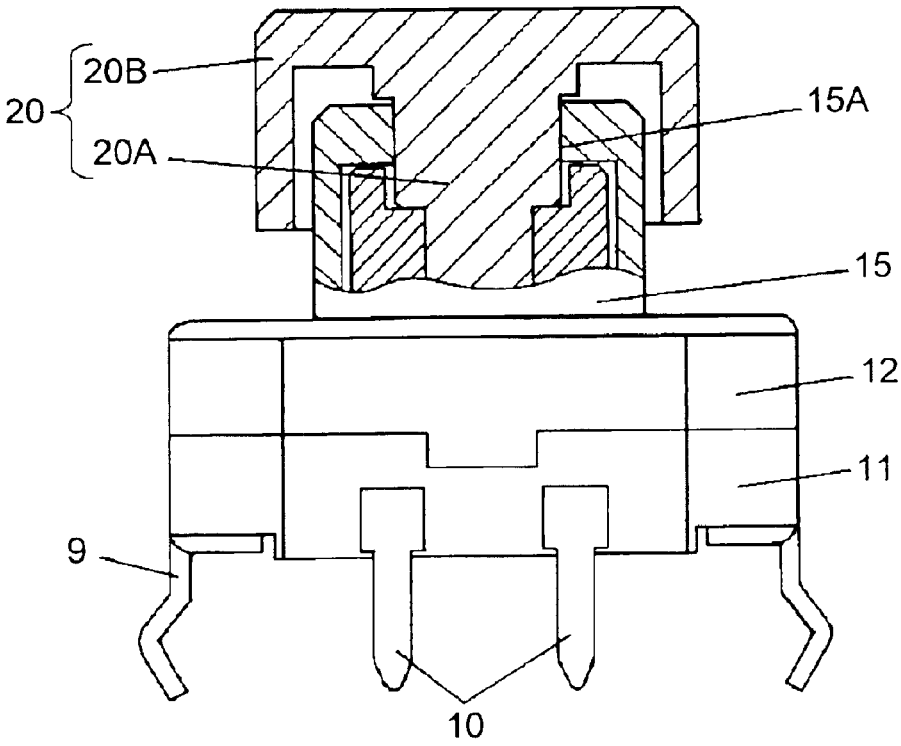
FIG. 4 is a partially sectional view of a third rotary encoder described in the embodiment 1.
Figure 5:
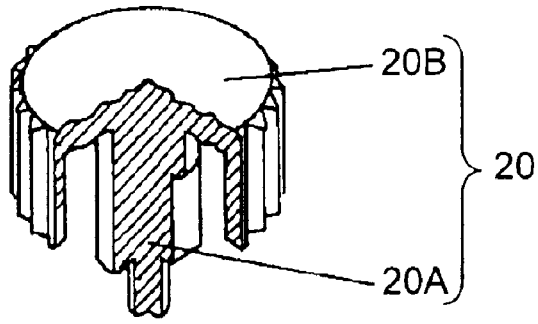
FIG. 5 is partially cutaway view in perspective of a shaft with a knob of the third rotary encoder described in the embodiment 1.

Further, as shown in FIG. 4, i.e. a front view of partial section of a rotary encoder of a third structure in accordance with this embodiment, and in FIG. 5, i.e. a partially cutaway view in perspective of a shaft with a knob, it is also possible to integrally form rotating shaft portion 20A and knob portion 20B by die-casting a metal, such as aluminum and zinc, or other method, to provide shaft with a knob 20.

The structure of FIG. 4 allows mass-production of rotary encoders having knob portions 20B of an identical shape and dimension with a smaller number of constituent members at low cost. The structure also provides secure connection of knob portion 20B and rotating shaft portion 20A.

Embodiment 2

In the embodiment 2, a description is provided of another example of the rotary manipulation type electronic component of the present invention by illustrating a rotary encoder.

In the description, constituents similar to those in the embodiment 1 have the same reference marks.

Figure 6:
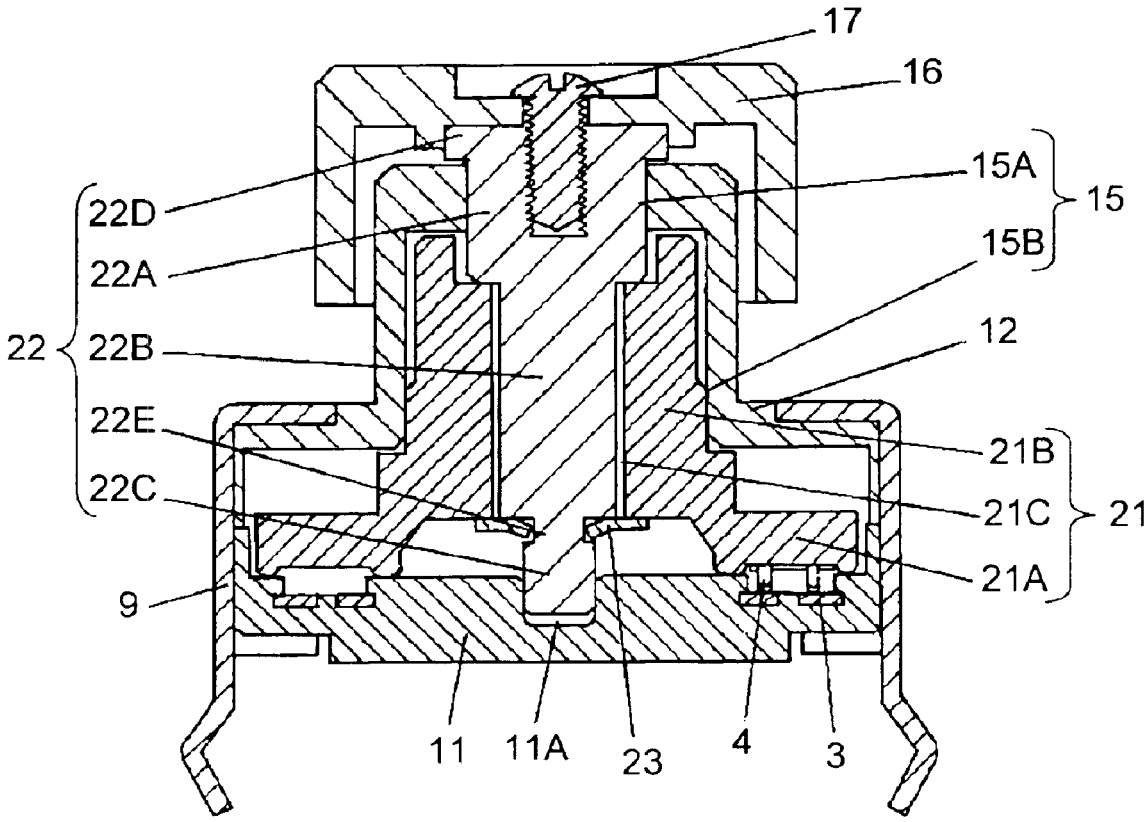
FIG. 6 is a sectional view of a rotary encoder described in a embodiment 2 of the present invention.

FIG. 6 is a sectional view of a rotary encoder as a rotary manipulation type electronic component in accordance with the embodiment 2 of the present invention.

As shown in FIG. 6, the rotary encoder of this embodiment has a method of supporting rotating body 21 different from that of the embodiment 1.

Upper circular portion 22A and lower circular portion 22C of straight rod-like rotating shaft 22 are rotatably supported by first bushing 15A along the inner circumference of cylindrical barrel portion 15 in the upper portion of case 12, and second bushing 11A in the top face of base 11, respectively. Cap-shaped knob 16 is disposed to cover barrel portion 15 and top end 22D of rotating shaft 22, and secured onto top end 22D of rotating shaft 22 with machine screw 17. These structures are the same as those of the embodiment 1. As for rotating body 21 of the embodiment 2, in addition to the above supporting points, the circular outer circumference of hollow shaft portion 21B above disc portion 21A holding resilient contact 4 is rotatably supported by the bottom circular portion (hereafter referred to as a "third bushing") along the inner circumference of cylindrical barrel portion 15 in the upper portion of case 12. In the embodiment 2, only one supporting point is added. However, a plurality of supporting points can be provided additionally.

Third bushing 15B along the inner circumference of barrel portion 15A is provided as a circular supporting point concentric with first bushing 15A along the inner circumference of barrel portion 15 and second bushing 11A in the top face of base 11.

However, there are machining errors in producing case 12, base 11, and rotating body 21 as individual pieces and misalignment in assembling theses pieces. For these reasons, a center line connecting the center of first bushing 15A along the inner circumference of barrel portion 15 and the center of second bushing 11A in the top face of base 11 that support rotating shaft 22 may be slightly eccentric in non-circular hole 21C through rotating body 21 with which intermediate non-circular portion 22B of rotating shaft 22 is engaged. To prevent this eccentricity, intermediate non-circular portion 22B of rotating shaft 22 is engaged with non-circular hole 21C of rotating body 21 with a gap equal or more than the eccentric quantity (e.g. approx. 0.03 to 0.04 mm) provided therebetween. This structure accommodates to the eccentric quantity.

In FIG. 6, the gap is emphasized and illustrated larger.

Fitted into groove 22E provided in the lower portion of rotating shaft 22 in contact with the bottom face of rotating body 21 is washer 23 for preventing rotating shaft 22 from coming off upwardly.

The rotary encoder of the embodiment 2 is structured as above. The operation thereof at manipulation of knob 16 is the same as that of the embodiment 1.

For the rotary encoder of the embodiment 2, because supporting rotating body 21 at third bushing 15B along the inner circumference of barrel portion 15 stabilizes the running torque of rotating shaft 22, smooth operational sensation can be obtained. Additionally, the position of resilient contact 4 held by rotating body 21 as a movable element is stabilized independently of the gap around rotating shaft 22. Further, providing a predetermined amount of gap in the portion where rotating body 21 and rotating shaft 22 are engaged with each other produces a small idle angle in the rotating direction of rotating shaft 22. However, because the rotary encoder is structured so that rotating shaft 22 is supported at thee points: (1) first bushing 15A along the inner circumference of barrel portion 15, (2) second bushing 11A in the top face of base 11, and (3) third bushing 15B along the inner circumference of barrel portion 15, uneven rotation at rotary manipulation can be prevented.

In the above description, the outer circumference of hollow shaft portion 21B in the upper portion of rotating body 21 is rotatably supported by third bushing 15B along the inner circumference of barrel portion 15 in the upper portion of case 12. However, the rotating body can also be rotatably supported by the top face of base 11 or other members.

Also in the rotary encoder of the embodiment 2, cap-shaped knob 16 can be secured onto rotating shaft 22 by another method described as the other structures in the embodiment 1.

Embodiment 3

In the embodiment 3, a description is provided of another example of the rotary manipulation type electronic component of the present invention by illustrating a rotary encoder.

In the description, constituents similar to those in the embodiment 2 have the same reference marks.

Figure 7:
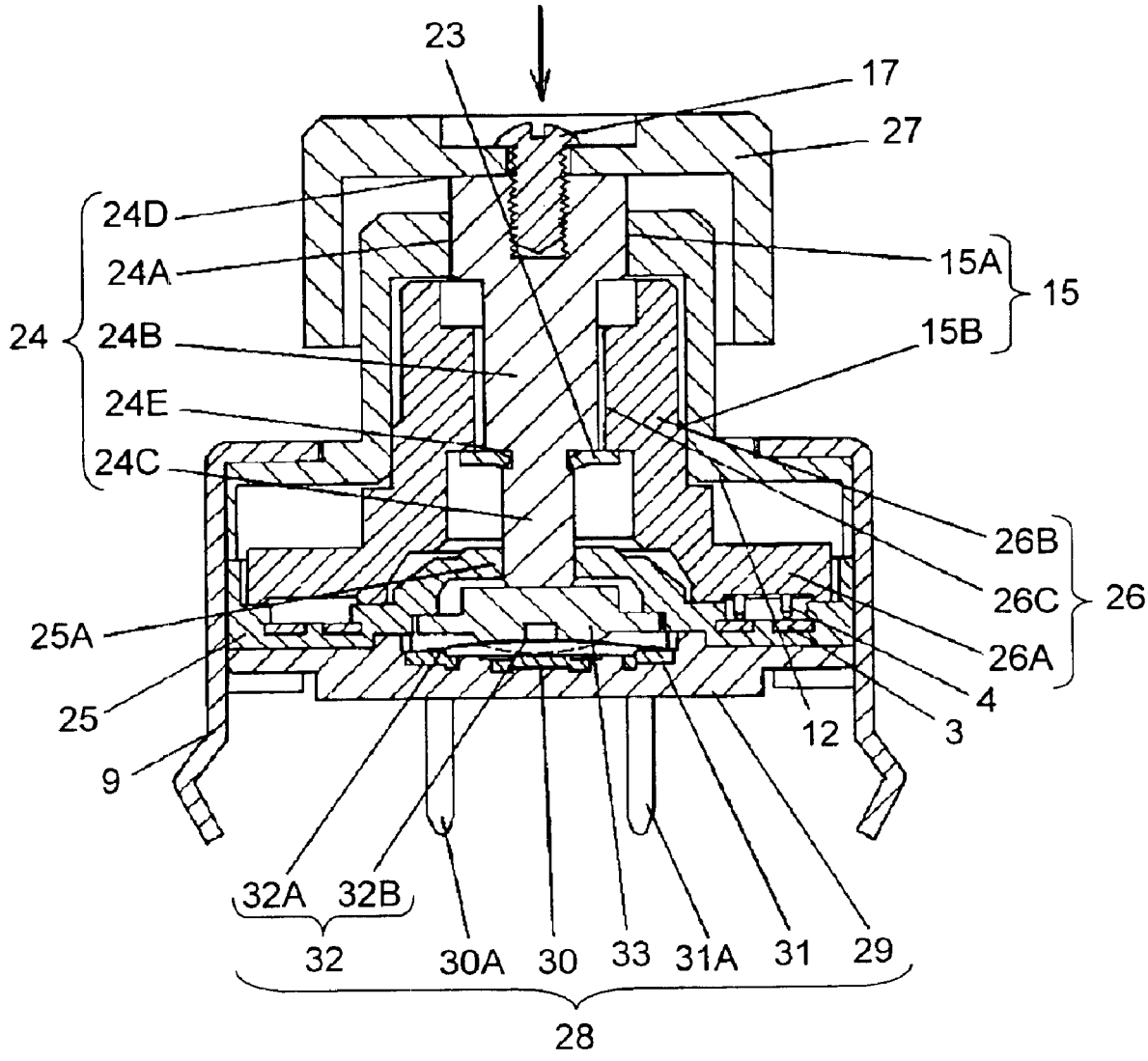
FIG. 7 is a sectional view of a rotary encoder described in a embodiment 3 of the present invention.
Figure 8:
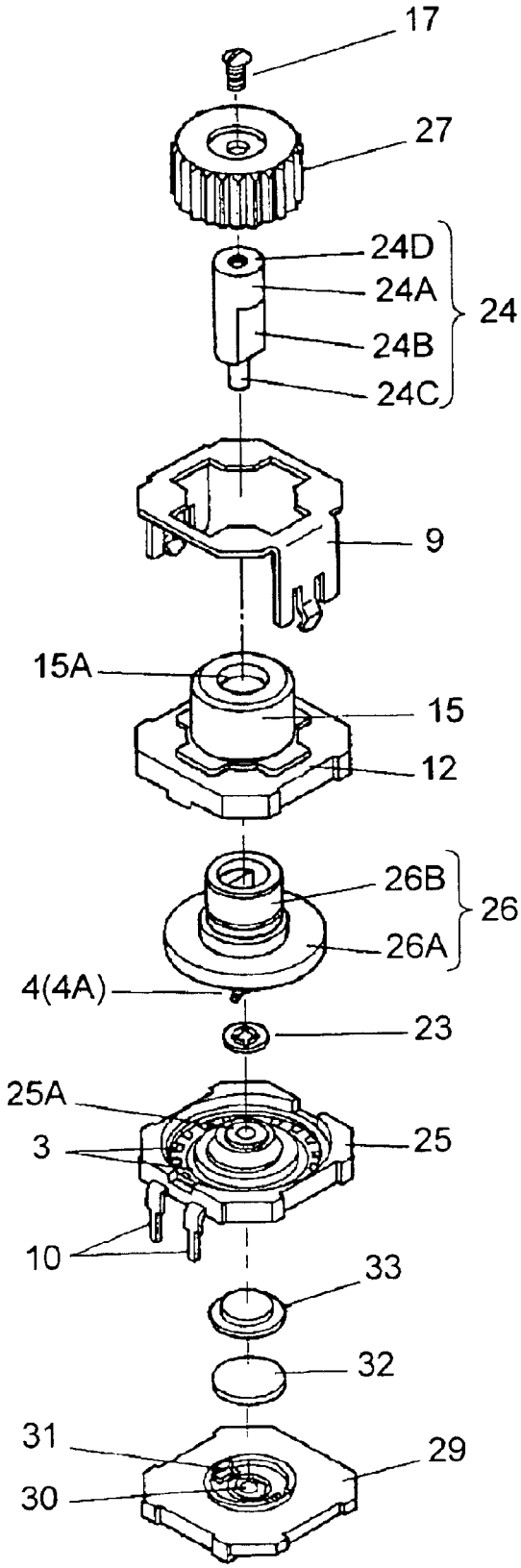
FIG. 8 is an exploded perspective view of the rotary encoder described in the embodiment 3.

FIG. 7 is a front sectional view and FIG. 8 is an exploded perspective view of a rotary encoder in accordance with the embodiment 3 of the present invention.

As shown in FIG. 7, some structures of the rotary encoder of the third exemplary embodiment are similar to those of the embodiment 2. For the rotary encoder of the embodiment 3, in addition to these structures, rotating shaft 24 is supported to be movable vertically, and dome-like switch (push switch) 28 for generating a second electric signal corresponding to vertical movement of rotating shaft 24 is provided below base 25.

Upper circular portion 24A and lower circular portion 24C of straight rod-like rotating shaft 24 are rotatably and vertically movably supported by first bushing 15A along the inner circumference of cylindrical barrel portion 15 in the upper portion of case 12, and circular through hole (i.e. fourth bushing) 25A formed through base 25, respectively.

As for rotating body 26, the circular outer circumference of hollow shaft portion 26B above disk portion 26A that holds resilient contact 4 is rotatably supported by third bushing 15B along the inner circumference of barrel portion 15. These structures are the same as those of the embodiment 2. Between intermediate non-circular portion 24B of rotating shaft 24 and non-circular hole 26C through rotating body 26, a gap equal or larger than that of the embodiment 2 (e.g. 0.04 to 0.05 mm) is provided. This allows rotating shaft 24 to rotate together with rotating body 26 but make vertical movement independently of the rotating body.

In FIG. 7, the gap is emphasized and illustrated larger.

Additionally, cap-shaped knob 27 is secured onto top end 24D of rotating shaft 24 protruding from barrel portion 15 with machine screw 17. Washer 23 for preventing rotating shaft 24 from coming off is fitted into groove 24E in the lower portion of rotating shaft 24. These structures are the same as those of the embodiment 2. Under ordinary conditions, rotating shaft 24 is forced upwardly by the resilient restoring force of push switch 28 so as to be placed at the top end of the vertically movable range thereof as described hereinafter. Washer 23 is in contact with the bottom face of rotating body 26.

Contact plate 29 for push switch 28 is disposed under base 25 that has concentric circular comb-like contact 3 on the inner top face thereof, in contact with the base. Contact plate 29 is fastened together with case 12 and base 25 by connecting fitting 9.

Formed on contact plate 29 by insert molding are central fixed contact 30 and circumferential fixed contact 31 connecting to switch terminals 30A and 31A, respectively. Mounted on circumferential fixed contact 31 is outer circumferential bottom edge 32A of circular dome-shaped movable contact 32 made of a resilient thin metal plate. Theses members form a contact part of push switch 28. Under ordinary conditions, the bottom face of central portion 32B of the dome shape of movable contact 32 is opposed to central fixed contact 30 with a predetermined switch gap provided therebetween.

Disk-like part 33 made of a resin is mounted on the top face of central portion 32B of circular dome-shaped movable contact 32. Further, the bottom end of lower circular portion 24C of rotating shaft 24 is in contact with the top face of the part.

In order to prevent the total height of the rotary encoder including push switch 28 from increasing, members constituting push switch 28 are disposed inside of the inner circumference of concentric circular comb-like contact 3 on the inner top face of base 25.

The rotary encoder of the embodiment 3 is structured as above. The operation at rotary manipulation of knob 27 is similar to those of embodiments 1 and 2.

Next, the vertical operation is described.

When knob 27 and rotating shaft 24 coupled thereto are depressed downwardly as shown by the arrow at the top of FIG. 7, central portion 32B of circular dome-shaped movable contact 32 is depressed downwardly via part 33. Then, movable contact 32 is resiliently inverted as shown by the dotted line in FIG. 7, and the bottom face of central portion 32B is brought into contact with central fixed contact 30. This short-circuits circumferential fixed contact 31 and central fixed contact 30, i.e. switch terminals 30A and 31A, thereby turning on the switch.

Thereafter, when the depressing force applied to knob 27 is removed, movable contact 32 is restored to the original dome shape thereof by resilient restoring force of its own. This causes movable contact 32 to leave central fixed contact 30 and push rotating shaft 24 upwardly via part 33, thereby turning off the switch.

As described above, for the embodiment 3, rotating shaft 24 and rotating body 26 are engaged with each other so as to rotate together but make vertical movement independently. Additionally, push switch 28 operated by vertical movement of rotating shaft 24 caused by a depressing operation is provided below base 25 so as to be housed inside of concentric circular comb-like contact 3 on the inner top face of the base 25.

These structures can provide a small rotary manipulation type encoder that has push switch 28 for generating a second electric signal corresponding to vertical movement of rotating shaft 24 and a small height including knob 27, although the encoder has a small idle angle in the rotation direction of rotating shaft 24. In the embodiment 3, the description is provided using a dome-like switch as the push switch. However, another type of switch having a similar resilient repetitive action can also be used.

Figure 9:
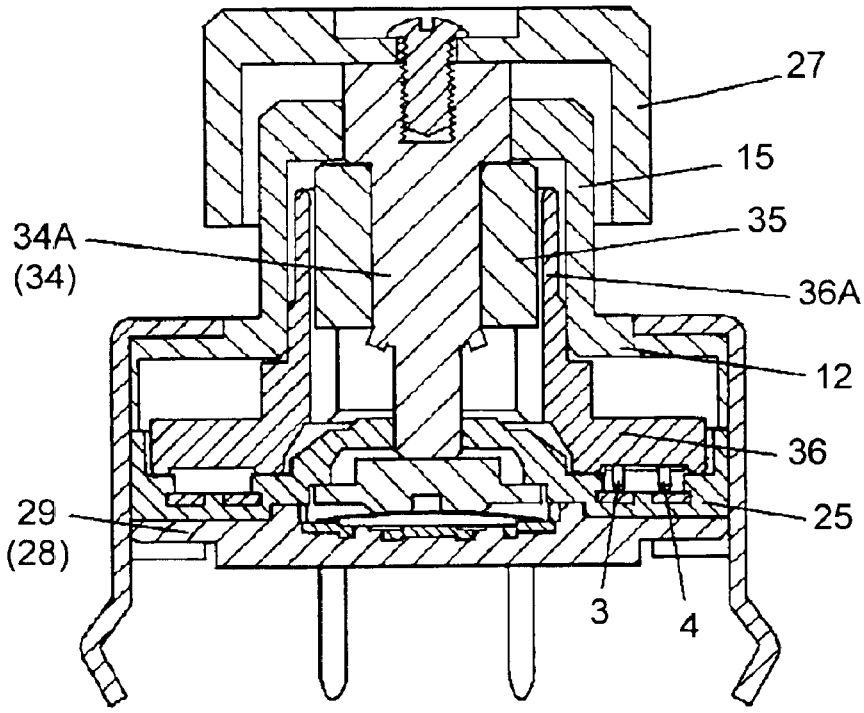
FIG. 9 is a sectional view of a rotary encoder of another structure described in the embodiment 3.

FIG. 9 is a sectional view of a rotary encoder of another structure in accordance with the embodiment 3. The structure is similar to that of the rotary encoder shown in FIG. 7. However, there is a difference in the structure of the portion in which rotating shaft 24 and rotating body 26 are engaged with each other so as to rotate together but make vertical movement independently.

Figure 10:
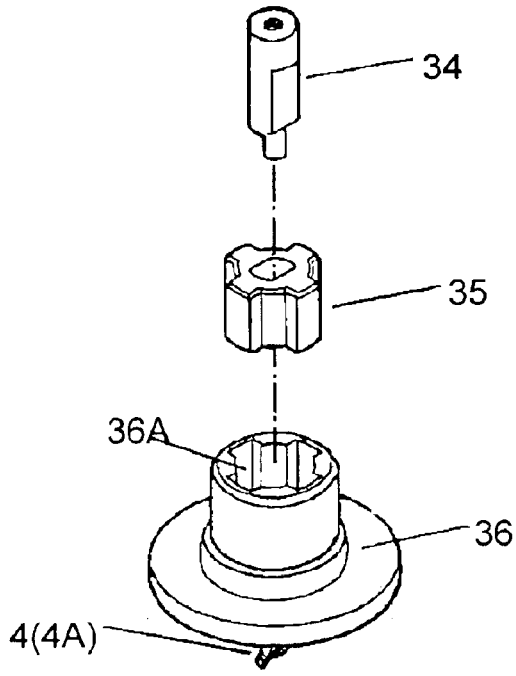
FIG. 10 is an exploded perspective view of an essential part of the rotary encoder of another structure described in the embodiment 3.
Figure 11:
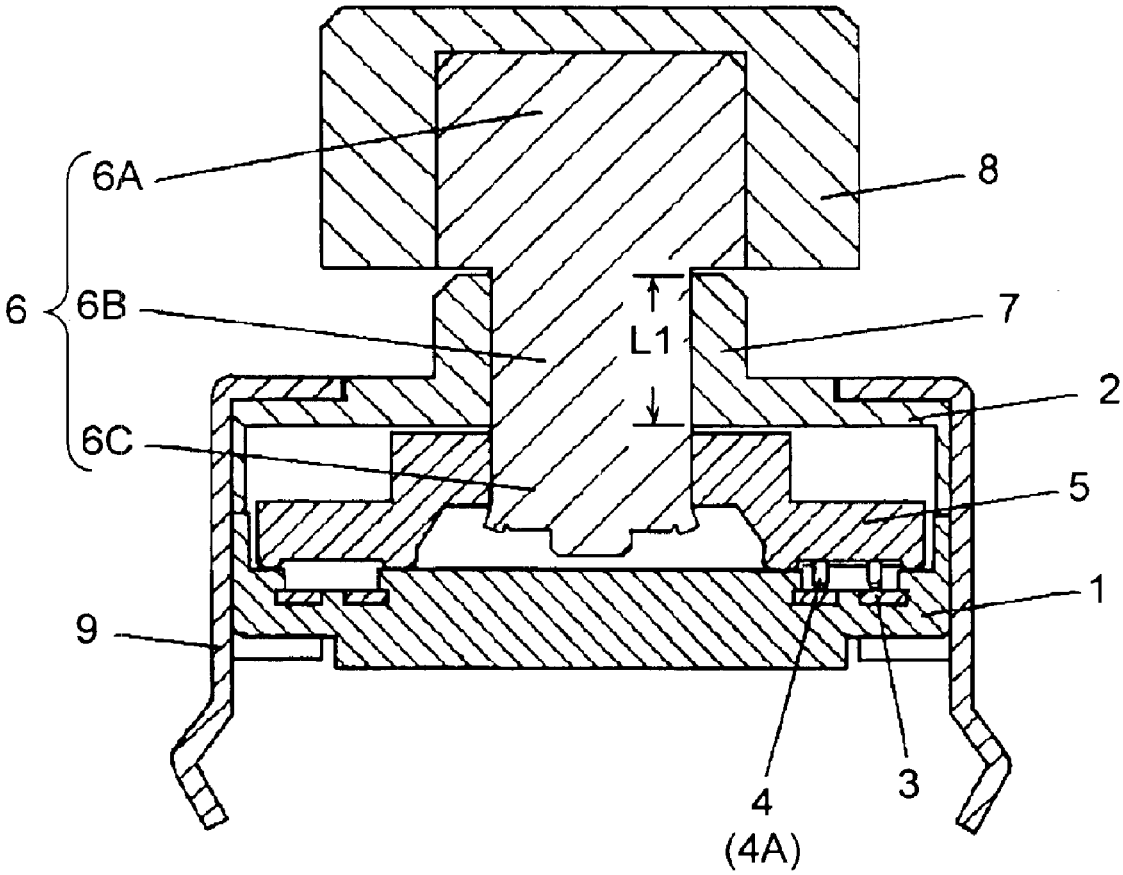
FIG. 11 PRIOR ART
FIG. 11 is a sectional view of a conventional rotary encoder.
Figure 12:
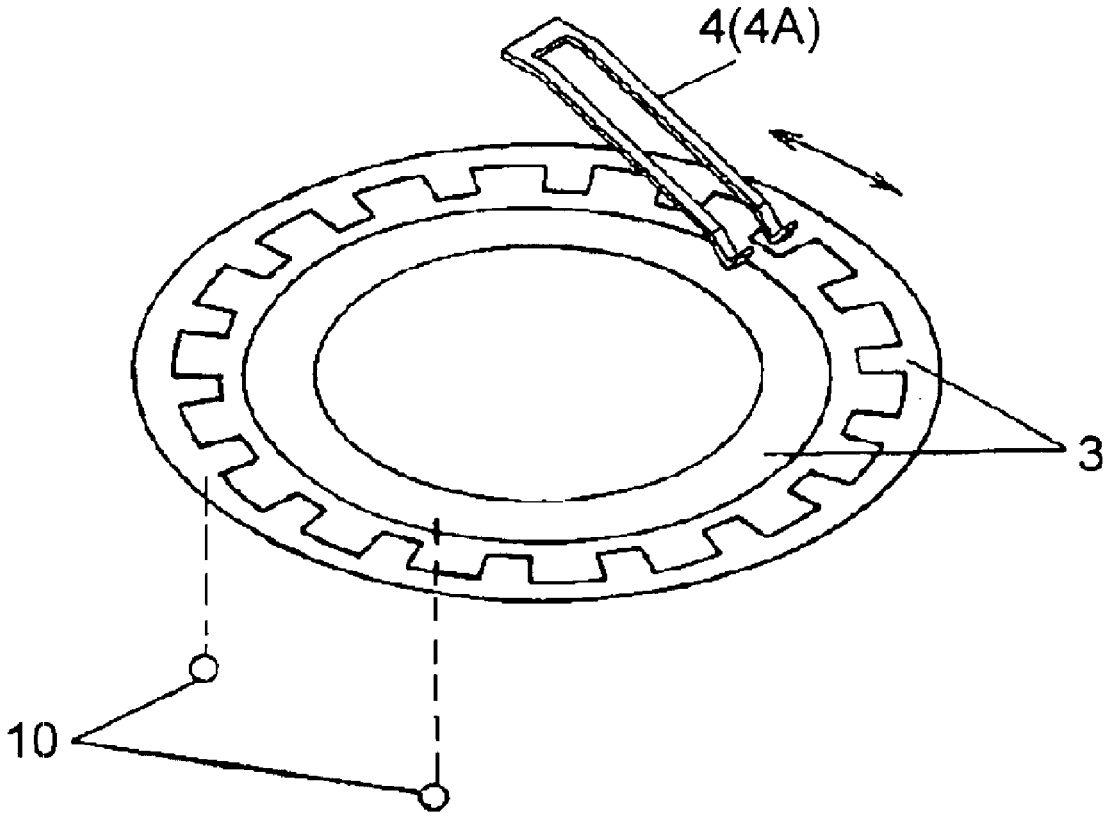
FIG. 12 PRIOR ART
FIG. 12 a schematic diagram illustrating how elements of the conventional rotary encoder are engaged with each other.

In other words, as shown in FIGS. 9 and 10, joined by caulking and fixed to intermediate non-circular portion 34A of rotating shaft 34 is non-circular sleeve 35 that has an outer periphery larger than that of intermediate non-circular portion 34A. A gap substantially equal to that of FIG. 7 (e.g. 0.04 to 0.05 mm) is provided between the noncircular outer periphery of this sleeve 35 and non-circular hole 36A having a larger aperture size through rotating body 36. Therefore, the rotating shaft and rotating body are engaged with each other so as to rotate together but make vertical movement independently.

For this structure, the operations at rotation and depression of knob 27 are the same as those shown in FIG. 7. However, the idle angle in the rotation direction of rotating shaft 34 can be reduced in proportion to the diameter of the portion in which rotating shaft 34 and rotating body 36 are engaged with a gap provided therebetween.

Also in the rotary encoder of the embodiment 3, rotating body 26 or 36 can be rotatably supported by the top face of base 25 or other members, instead of barrel portion 15 of case 12. Cap-shaped knob 27 can also be secured onto rotating shaft 24 or 34 by another method described as the other structures in the embodiment 1.

As described above, the present invention can provide a high-precision small rotary manipulation type electronic component that has a small height, a less back-lash knob and a small runout of the rotating shaft.

We claim:

1. A rotary manipulation type electronic component comprising:

a case having an opening on a top face thereof used as a first bushing;

a rotating shaft rotatably supported by the first bushing;

a rotating body fixed to said rotating shaft and housed in said case;

a base covering a bottom face of said case;

a resilient contact attached to a bottom face of said rotating body;

a circular comb-like fixed contact formed on a top face of said base and making contact with said resilient contact to generate a electric signal; and a knob secured onto a first end of said rotating shaft protruding from said case;

wherein said electronic component further includes at least one additional bushing below said rotating body rotatably supporting said rotating shaft, said knob is shaped like a cap, said knob extends below a top of said first bushing and surrounds the first bushing.

2. The rotary manipulation type electronic component of claim 1, wherein a second bushing of the additional bushing is a recess formed in the top face of said base, and rotatably supports a second end of said rotating shaft.

3. The rotary manipulation type electronic component of claim 2, wherein said case further includes a third bushing rotatably supporting said rotating body, said rotating body has a concentric circular step at a position opposed to the third bushing, and said rotating shaft and said rotating body are substantially concentrically fixed to each other with a predetermined gap provided therebetween.

4. The rotary manipulation type electronic component of claim 1, wherein said electronic component further includes a push switch below said base, the additional bushing is a second bushing provided as an opening through said base, the second bushing rotatably and vertically movably supports a second end of said rotating shaft, and said rotating shaft penetrates said base and contacts with the push switch.

5. The rotary manipulation type electronic component of claim 4, wherein the push switch is a dome-like switch.

6. The rotary manipulation type electronic component of claim 4, wherein said case further includes a third bushing rotatably supporting said rotating body, said rotating body has a concentric circular step at a position opposed to the third bushing, and said rotating shaft and said rotating body are substantially concentrically fixed to each other with a predetermined gap provided therebetween.

7. The rotary manipulation type electronic component of claim 6, wherein said electronic component further includes a sleeve fixed to said rotating shaft and having an outer peripheral shape, said rotating body has an inner peripheral shape similar to and larger than the outer peripheral shape of the sleeve, the sleeve is engaged with said rotating body with a predetermined gap provided therebetween, and the sleeve supports said rotating body so as to allow vertical movement of said rotating body but restricts rotation of said shaft relative to said rotating body.

8. The rotary manipulation type electronic component of claim 1, wherein said knob is secured onto the first end of said rotating shaft with a machine screw.

9. The rotary manipulation type electronic component of claim 1, wherein said rotating shaft has a recess at the first end of said rotating shaft, said knob has a protrusion integrally formed on an inner bottom face thereof, and the protrusion of said knob is press-fitted and secured into the recess of said rotating shaft.

10. The rotary manipulation type electronic component of claim 1, wherein said rotating shaft and said knob are integrally molded.

11. A rotary manipulation type electronic component according to claim 1, wherein said base is wider than said knob.

12. A rotary manipulation type electronic component according to claim 1, wherein said one additional bushing remains stationary relative to said shaft.

13. A rotary manipulation type electronic component according to claim 12, wherein said one additional bushing directly holds said rotating shaft.

14. A rotary manipulation type electronic component according to claim 1, wherein said one additional bushing directly holds said rotating shaft.

* * * * *